US006647221B1

(12) United States Patent
Furuyama

(10) Patent No.: US 6,647,221 B1
(45) Date of Patent: Nov. 11, 2003

(54) IMAGE FORMING APPARATUS WITH HEAT CONTROL FOR VARYING SHEET THICKNESSES

(75) Inventor: Noboru Furuyama, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/227,444

(22) Filed: Aug. 26, 2002

(51) Int. Cl.[7] ..... G03G 15/20
(52) U.S. Cl. ..... 399/69; 399/45
(58) Field of Search ..... 399/67, 69, 45, 399/75, 321, 328, 330, 336, 68, 322, 400, 329; 219/216, 244

(56) References Cited

U.S. PATENT DOCUMENTS 5,512,992 A * 4/1996 Kim et al. ..... 399/69
6,087,641 A * 7/2000 Kinouchi et al. ..... 399/67
6,427,060 B1 * 7/2002 Arakawa et al. ..... 399/45
6,496,666 B2 * 12/2002 Hayashi et al. ..... 399/69
2002/0031362 A1 * 3/2002 Baba ..... 399/69

FOREIGN PATENT DOCUMENTS

| | | | |
|---|---|---|---|
| JP | 4-322284 | 11/1992 | |
| JP | 06337616 A | * 12/1994 | ..... G03G/15/20 |
| JP | 9-80968 | 3/1997 | |
| JP | 10-104990 | 4/1998 | |

* cited by examiner

*Primary Examiner*—Robert Beatty
(74) *Attorney, Agent, or Firm*—Foley & Lardner

(57) ABSTRACT

A fixing device includes an endless fixing belt wound around a fixing roller and a heating roller so as to make the fixing roller to be pressed against a pressurizing roller at a nip section by way of the fixing belt. A heating lamp is arranged in the inside of the heating roller and, as the heating section of the fixing belt that is heated by the heating roller moves gets to the nip section so as to contact with an image forming medium that passes through the nip section, the unfixed image on the image forming medium is fixed under the effect of heat and pressure. The fixing belt is made to rotate idly with the heating lamp turned off after the end of the image fixing operation in a cardboard mode.

6 Claims, 6 Drawing Sheets

IMAGE FORMING APPARATUS WITH HEAT CONTROL FOR VARYING SHEET THICKNESSES

BACKGROUND OF THE INVENTION

This invention relates to an image forming apparatus such as a full-color copying machine or a color printer.

As a type of fixing device, there are heating/pressurizing type fixing devices having a fixing belt system that are used for copying machines and printers adopting an electrophotography system.

Such a fixing device comprises an endless fixing belt wound around a fixing roller and a heating roller so as to make the fixing roller to be pressed against a pressurizing roller by way of the fixing belt.

A heater lamp is arranged in the inside of the heating roller and, and as the heating section of the fixing belt that is heated by the heating roller gets to the nip section comprising the fixing roller and pressurizing roller so as to contact with a sheet of recording paper that passes through the nip section, the unfixed image on the sheet of recording paper is fixed under the effect of heat and pressure.

Such color copying machines and color printers are adapted to use recording paper that may be thin paper, ordinary plain paper or cardboard of a variety of types.

In such a color copying machine or a color printer, the operation of driving the fixing device and the recording paper conveying system is stopped immediately after the completion of a printing sequence. Then, the temperature of the heating roller and the fixing belt is raised by the residual heat. Therefore, the temperature of the fixing belt rises above the target level when a printing operation is conducted in a plain paper mode immediately after a printing operation in a cardboard mode to consequently give rise to problems such as high temperature offset (where some of the toner fixed to the sheet comes off).

In an attempt to avoid this problem, an image forming apparatus is so controlled that no sheets of recording paper pass through it until the temperature of the fixing belt reaches the target level. Then, however, there arises a problem that a printing operation in a fast copy mode is a time consuming one because the cooling rate is low when the fixing belt is left to cool down spontaneously.

BRIEF SUMMARY OF THE INVENTION

The object of this invention is to provide an image forming apparatus comprising a fixing device having a fixing belt that can reduce the standby time for an operation of fixing an image on a sheet of plain paper or thin paper when the operation is conducted immediately after fixing an image on a sheet of cardboard.

According to the invention, the above object is achieved by providing an image forming apparatus comprising a fixing device for fixing a color developer image on an image forming medium having a thickness selected from a number of different thicknesses, the fixing device including:

- a fixing roller for fixing a color developer image of an image forming medium having a thickness selected from a number of different thicknesses at temperature selected from a number of different temperatures corresponding to the thicknesses of image forming medium;
- a heating roller containing a heat source and adapted to be heated by the heat source;

- a fixing belt wound around the fixing roller and the heating roller and adapted to move around the rollers so as to transmit heat from the heating roller to the fixing roller;
- a first drive section for driving the heat source;
- a second drive section for rotating the fixing roller;
- a detector for detecting the temperature of the heating roller;
- a first control section for controlling the operation of the first drive section of driving the heat source and that of the second drive section of rotating the fixing roller to rotate according to the temperature detected by the detector; and
- a second control section adapted to stop the operation of driving the heat source in a rotating state of the fixing roller after the passage of a thick image forming medium through the nip section of the fixing roller for the purpose of fixing an image on an image forming medium having an ordinary thickness or a thickness smaller than the ordinary thickness to immediately succeed the operation of fixing an image on the thick image forming medium and stop the operation of rotating the fixing roller upon detecting a predetermined temperature by means of the detector.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, an embodiment of image forming apparatus according to the invention will be described by referring to the accompanying drawings.

Figure 1:
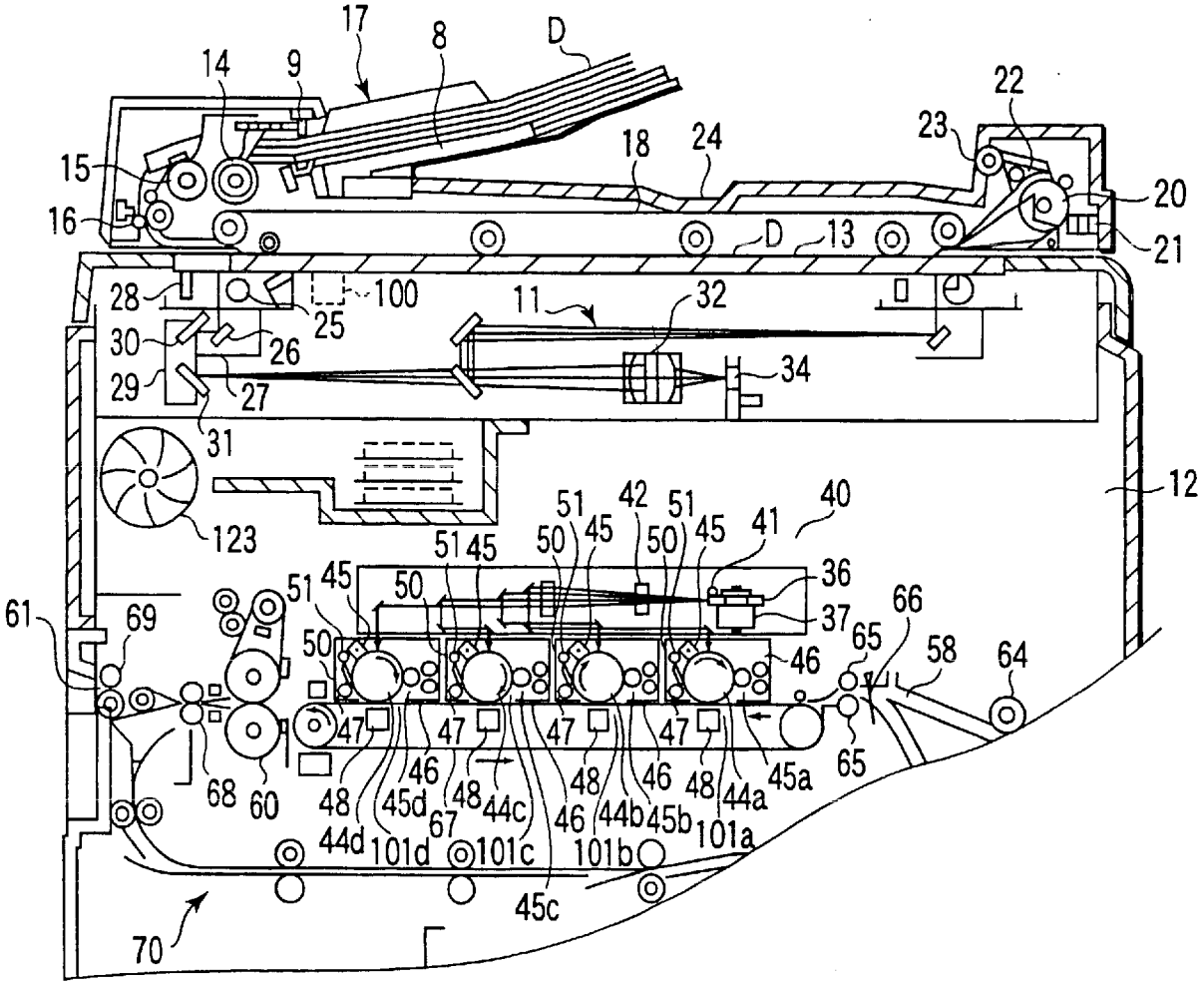
FIGS. 1 and 2 are schematic cross sectional views of an image forming apparatus according to the invention.
Figure 2:
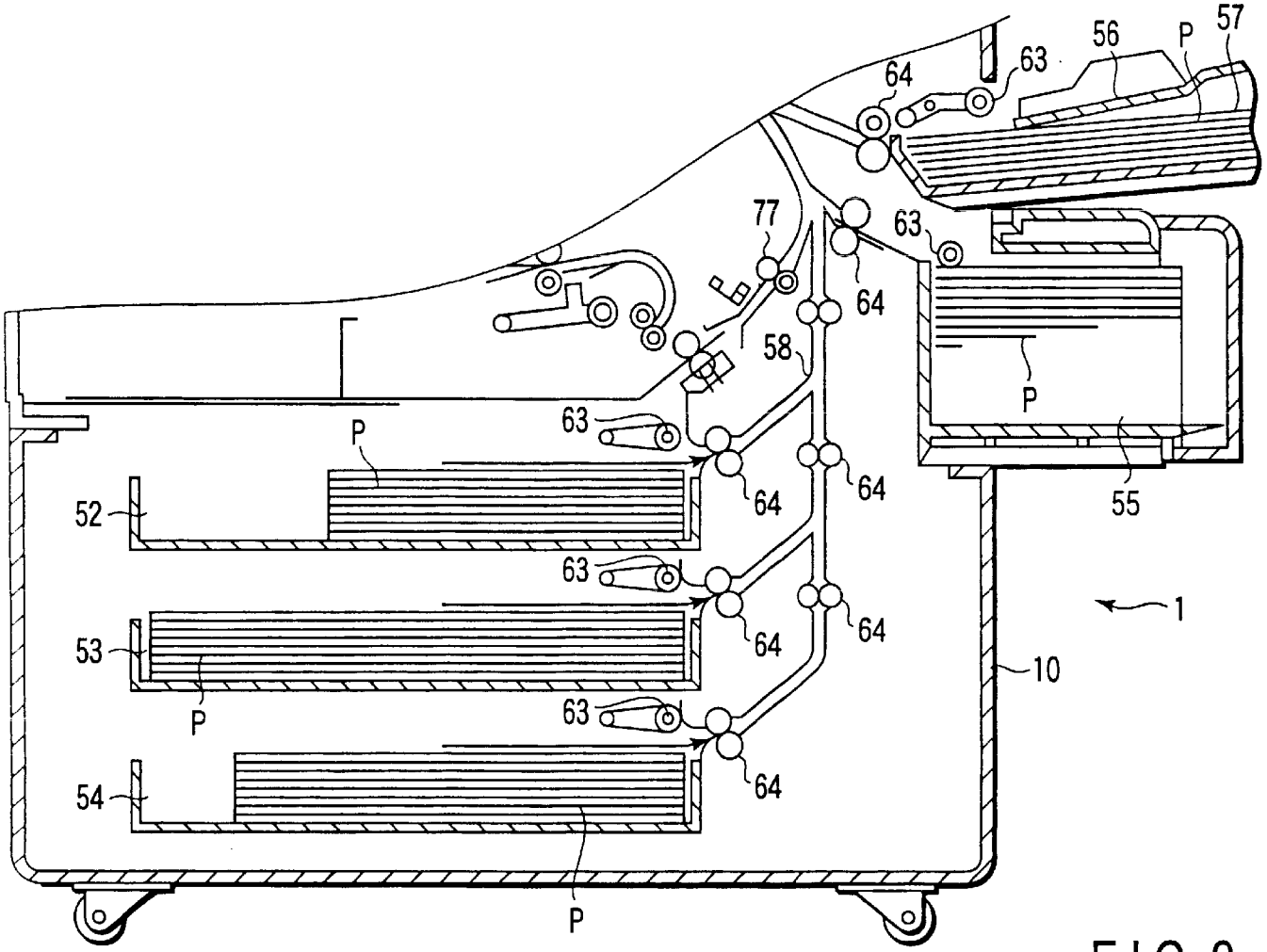

FIGS. 1 and 2 are schematic cross sectional views of an embodiment of the image forming apparatus according to the invention, which is a color digital copying machine 1.

As shown in FIGS. 1 and 2, the digital copying machine 1 comprises an apparatus main body 10, inside which is a scanner section 11 that operates as reading means, and a color printer section 12 that operates as image forming means.

An original placement table 13, which is made of transparent glass and adapted to receive an object to be read, or original D, and an ADF 17 for automatically feeding the original D onto the original placement table 13 are arranged at the top of the apparatus main body 10. The ADF 17 is arranged in such a way that it can be made opened and closed relative to the original placement table 13 and operates as original holder for holding the original D placed on the original placement table 13 in tight contact with the latter. The ADF 17 draws original D from the original holder with pick up roller 14, and conveys the original D from pick up roller 14 to the original placement table 13 with transfer roller 15 and guide 16.

The scanner section 11 arranged in the inside of the apparatus main body 10 includes a light source 25, which may be a fluorescent lamp, for lighting the original D placed on the original placement table 13 and a first mirror 26 for deflecting the rays of light reflected from the original D to a predetermined direction. The light source 25 and the first mirror 26 are fitted to a first carriage 27 arranged below the original placement table 13. The first carriage 27 is arranged below the original placement table 13 so as to reciprocate in a direction parallel to the latter.

A second carriage 29 is also arranged below the original placement table 13 so as to be movable in a direction parallel to the latter. Second and third mirrors 30, 31 are fitted to the second carriage 29 rectangularly relative each other so as to sequentially deflect the rays of light reflected from the original D and deflected by the first mirror 26. The second carriage 29 is so arranged as to follow the movement of the first carriage 27 by means of a toothed belt provided to drive the first carriage 27 and move in a direction parallel to the original placement table 13 at a speed equal to ½ of the moving speed of the first carriage.

An image forming lens 32 for focusing the flux of rays of light reflected from the third mirror 31 on the second carriage 29 and a CCD sensor 34 for receiving the reflected rays of light focused by the image forming lens 32 are arranged below the original placement table 13. The image forming lens 32 is adapted to be driven by a drive mechanism to move on a plane including the optical axis of the flux of light deflected by the third mirror 31 so as to form an image out of the reflected light with a desired magnification as it moves. Then, the CCD sensor 34 performs an operation of photoelectric conversion on the incident reflected light and outputs an electric signal corresponding to the original D that is read out.

On the other hand, the color printer section 12 is provided with a laser exposure device 40 that operates as exposure means. The laser exposure device 40 has a semiconductor laser 41 as light source, a polygon mirror 36 for continuously deflecting the laser beam emitted from the semiconductor laser 41 as scanning member, a polygon motor 37 for driving the polygon mirror 36 to rotate at a predetermined number of revolutions per unit time, which will be described hereinafter, and a scanning motor and an optical system 42 for deflecting the laser beam from the polygon mirror 36 and leading it to photosensitive drums 44*a* through 44*d*, which will also be described hereinafter. The laser exposure device 40 having a configuration as described above is rigidly secured to and supported by the support frame (not shown) of the apparatus main body 10.

The laser exposure device 41 is on/off controlled according to the image information of the original D read out by the scanner section 11, and the laser beam emitted from it is directed to the photosensitive drums 44*a* through 44*d* by way of the polygon mirror 36 and the optical system 42 so as to scan the peripheral surfaces of the photosensitive drums 44*a* through 44*d* and form electrostatic latent images on the respective peripheral surfaces of the photosensitive drums 44*a* through 44*d*.

The image forming section 12 includes the photosensitive drums 44*a* through 44*d* that are freely rotatable and arranged at the center of the apparatus main body 10 so as to operate as image carriers. Desired electrostatic latent images are formed respectively on the peripheral surfaces of the photosensitive drums 44*a* through 44*d* as the latter are exposed to the laser beam from the laser exposure device 40.

The photosensitive drums 44*a* though 44*d* are provided around them respectively and sequentially with electric chargers 45, for electrifying the peripheral surfaces of the photosensitive drums 44*a* through 44*d* to a predetermined electric charge, developing devices 46, for supplying the electrostatic latent images formed on the peripheral surfaces of the photosensitive drums 44*a* through 44*d* with toner as developing agent to develop the latent images to a desired image density, release chargers 47, for releasing the transfer member (image forming medium, recording paper, recording medium), or copying sheet P, fed from the sheet feeding cassette 52, 53, 54, 55 or 57 from the photosensitive drums 44*a* through 44*d*, transfer chargers 48, for transferring the toner images formed on the photosensitive drums 44*a* through 44*d* onto the copying sheet P, release claws (not shown) for releasing the copying sheet P from the peripheral surfaces of the photosensitive drums 44*a* through 44*d*, cleaning devices 50, for cleaning the peripheral surfaces of the photosensitive drums 44*a* through 44*d* out of residual toner and charge eliminators 51, for eliminating the electric charges on the peripheral surfaces of the photosensitive drums 44*a* through 44*d*.

Thus, image forming units 101*a* through 101*d* are constituted respectively by the photosensitive drums 44*a* through 44*d* and the devices arranged around them.

In the instance of the embodiment of the invention, the image forming units 101*a* through 101*d* are so arranged as to form a Y image, an M image, a C image and a BK image on the copying sheet P in the sequence of Y, M, C and BK in a registered manner as viewed in the direction in which any selected point on conveyor belt 67 and hence the copying sheet P are moved.

The sheet feeding cassettes 52, 53, 54 that can be drawn out of the apparatus main body 10 are stacked in a lower part of the inside of the apparatus main body 10. The cassettes 52, 53, 54 contain copying sheets of various sizes. The sheet feeding cassette 57 that also operates as manual insertion tray 56 is removably arranged at a lateral side of the apparatus.

A conveyance path 58 is arranged in the inside of the apparatus main body 10 so as to extend from the cassettes through the transfer sections located between the photosensitive drums 44*a* through 44*d* and the corresponding transfer chargers 48. A fixing device 60 is arranged at the end of the conveyance path 58.

The sheet feeding cassettes 52, 53, 54, 55 and 57 are provided near them respectively with pick up rollers 63 for taking out copying sheets on a one by one basis. The conveyance path 58 is provided with a large number of sheet feeding roller pairs 64 for conveying the copying sheet picked up by one of the pick up rollers 63 through the path 58.

The conveyance path 58 is also provided at a position upstream to the photosensitive drums 44*a* through 44*d* with a register roller pair 65. The register roller pair 65 is adapted to correct the inclination of the taken out copying sheet P and align the front end of each of the toner images on the photosensitive drums 44*a* through 44*d* with the front end of the copying sheet P. It feeds the copying sheet P to the transfer section at the same speed as the moving speed of the peripheral surfaces of the photosensitive drums 44*a* through 44*d*. An aligning sensor 66 is arranged at the near side, or the side close to the sheet feeding roller 64, of the register roller pair 65 to detect the arrival of the copying sheet P.

The copying sheet P that is taken out one of the cassettes by the corresponding pick up roller 63 on a one by one basis is conveyed to the register roller pair 65 by the corresponding ones of the sheet feeding roller pairs 64. The front edge of the copying sheet P is placed in position by the register roller pair 65 and subsequently conveyed to the transfer section by the conveyor belt (transfer belt) 67.

In the transfer section, the developer images formed on the photosensitive drums 44*a* through 44*d*, or the toner images of the different colors, are transferred on the copying sheet P by the respective transfer chargers 48. Each time a toner image is transferred onto the copying sheet P from the corresponding one of the photosensitive drums 44*a* through 44*d*, it is released from the peripheral surface of the latter under the effect of the corresponding release charger 47 and the corresponding release claw (not shown) and eventually conveyed to the fixing device 60 by way of the conveyer belt 67 that operates as part of the conveyance path 58. The developer images, or the toner images are fused and fixed to the copying sheets P by the fixing device 60 under the effect of heat and pressure. The copying sheet P carrying the fixed toner images of the different colors is then discharged through sheet delivery port 61 by means of a sheet feeding roller pair 68 and a sheet delivery roller pair 69.

An operation panel for issuing commands that indicate various copying conditions including the magnification for copying an image and the start of a copying operation (start key) is arranged at an upper part of the front side of the apparatus main body 10.

Figure 3:
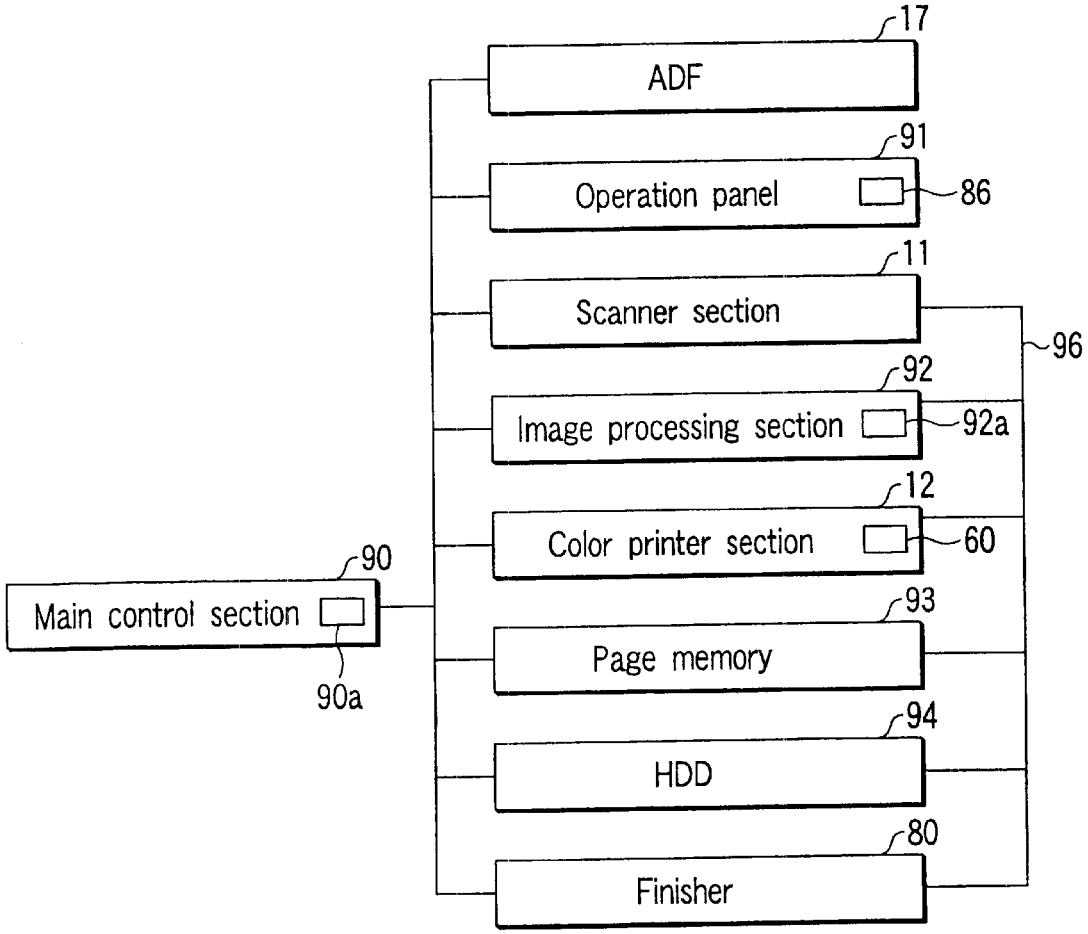
FIG. 3 is a schematic block diagram of the image forming apparatus.

Now, the internal configuration of the control circuit of the digital copying machine 1 will be described by referring to FIG. 3.

The digital copying machine 1 is provided with a main control section 110 for controlling the overall operation of the machine. Although not shown, the main control section 110 comprises a CPU (central processing unit) for controlling the operation of the machine, a ROM (read only memory) storing the software for operating the digital copying machine, a RAM (random access memory) (S-RAM) 110*a* temporarily storing image data and other data necessary for the operation of the machine.

The ADF 17, the scanner section 11, the color printer section 12, the operation panel 111, image processing section 112, page memory 113 and HDD 114 are connected to the main control section 110 by way of bus 115. The image processing section 112, the page memory 113 and the HDD 114 are connected by way of image bus 116.

The image processing section 112 processes the original image data read out by the scanner section 11 and the image data transmitted from the page memory 113 and the HDD 114 and outputs the processed image data to the page memory 113, the printer section 12 and the HDD 114.

The image processing section 112 has a color conversion section 112*a*. The color conversion section 112*a* converts the image data of red, green and blue read out by the scanner section 11 into image data of yellow, magenta, cyan and black.

The HDD 114 is an external memory device that may typically be a hard disk for storing various data.

The main control section 110 has input tasks and printing tasks that are administered on a job by job basis.

The main control section 110 controls the operation of conveying copying sheets by means of signals from the sensors arranged along the conveyance paths. Copying sheets of cardboard 3 are fed by manual insertion and the speed of conveying a cardboard copying sheet is lower than the ordinary conveyance speed.

The main control section 110 controls the fixing operation of the fixing device 60 according to the thickness of the current copying sheet selected at the operation section and that of the preselected next copying sheet.

The copying machine can handle copying sheets of recording paper of five different types including thin paper, ordinary plain paper and three types of cardboard. The weight (per unit size) of thin paper is between 64 and 79 $g/m^2$ and the weight (per unit size) of ordinary plain paper is between 80 and 105 $g/m^2$, whereas the weight (per unit size) of cardboard 1 is between 106 and 163 $g/m^2$ and the weight (per unit size) of cardboard 2 and the weight (per unit size) of cardboard 3 are respectively between 164 and 209 $g/m^2$ and between 210 and 256 $g/m^2$.

Figure 4:
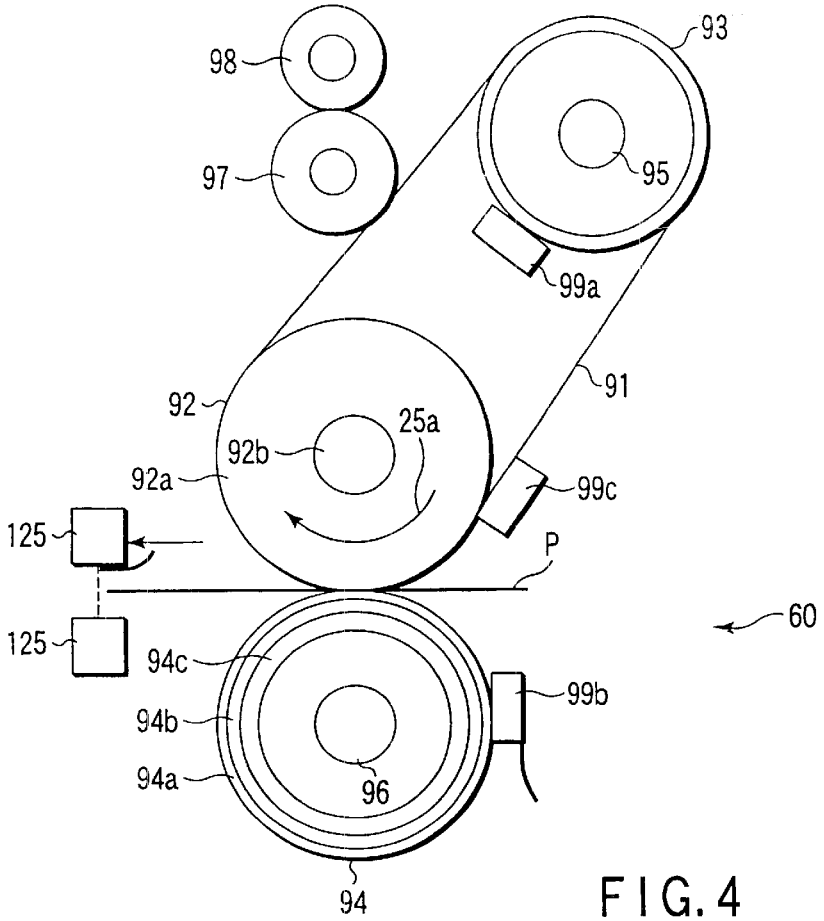
FIG. 4 is a schematic cross sectional view of the fixing device.

Now, each of the components of the fixing device 60 will be described by referring to FIG. 4.

The fixing belt 91 is formed by using a thin seamless belt formed by molding metal such as nickel or heat-resistant resin such as polyimide as a base member and covering or coating it with heat-resistant rubber, such as oil-impregnated silicon rubber, fluorine rubber, or fluorocarbon resin. The silicon rubber may be further covered or coated with heat-resistant resin that shows a high releasing effect such as PFA tube.

In this embodiment, a thin seamless belt having a thickness of 37 $\mu$m and made of electro-cast nickel is coated on the outer peripheral surface thereof with a 200 $\mu$m thick heat-resistant elastic layer of silicon rubber and the outer peripheral surface of the elastic layer is further covered by a 30 $\mu$m thick PFA tube.

The fixing belt 91 is wound around a heating roller 93 for heating the fixing belt 91 from the inside and applying tension to the latter and a fixing roller 92 for driving the belt and producing a fixing region between itself and a pressurizing roller 94.

The heating roller 93 is formed by coating a metal core of an aluminum pipe having a diameter of 30 mm and a wall thickness of 3 mm with PTFE to produce an approx. 20 $\mu$m thick cover layer. A 550 W heater lamp 95 is arranged in the inside of the heating roller 93 as heat source.

The fixing roller 92 is formed by covering a metal core 92*b* showing a hardness of 30 degrees (ASKER-C hardness) and having an outer diameter of 38 mm and a wall thickness of 8 mm with a heat-resistant elastic member 92*a* typically made of silicon sponge along the outer peripheral surface thereof. The heat-resistant elastic member 92*a* is preferably made of sponge from the viewpoint of providing high thermal insulation and a sufficient nipping effect with a low load. Alternatively, it may be made of rubber.

The pressurizing roller 94 arranged opposite the fixing roller 92 is subjected to a load of about 250 N by means of a spring (not shown) so as to press the fixing roller 92 with the fixing belt 91 interposed between them and provide a 7.5 mm long nip zone. The pressurizing roller 94 is formed by covering a metal core 94*c* of an aluminum pipe having a diameter of 40 mm and a wall thickness of 5 mm and showing a hardness of 80 degree (ASKER-C hardness) with silicon rubber (with JIS-A hardness of 20°) 94*b* to a thickness of 1 mm along the outer peripheral surface thereof. The silicon rubber is further covered by a 30 $\mu$m thick PFA tube 94*a*.

A 450 W heater lamp 96 is arranged in the inside of the pressurizing roller 94 as a heat source. An oil application roller 97 is arranged along the outer periphery of the fixing belt 92 in order to prevent any offset of toner relative to the fixing belt 91. A cleaning roller 98 is arranged along the outer periphery of the oil application roller 97 in order to remove the toner and paper debris adhering to the oil application roller 97.

The oil application roller 97 has a metal core having an outer dimension of 22 mm and wound by an oil-impregnated sheet of heat-resistant paper. The outside of the oil-impregnated sheet is further covered by a porous fluorine resin tube that operates for controlling oil application and shows a high releasing effect. This arrangement makes it possible to apply oil to the fixing belt at a very low rate. The cleaning roller 98 has an outer dimension of 21 mm and is formed by coating the surface of an aluminum roller with fluorine resin to a thickness of 20 $\mu$m.

Thermistor (first detector) 99*a* is arranged on the surface of the heating roller 93 in order to control the heater lamp 95 arranged in the inside of the heating roller 93. Thus, it is adapted to detect the surface temperature of the heating roller 93. The thermistor 99*a* may alternatively be arranged on the surface of the fixing belt 91 wound around the outer peripheral surface of the heating roller 93.

Thermistor (second detector) 99*b* is arranged on the surface of the pressurizing roller 94 in order to control the heater lamp 96 arranged in the inside of the pressurizing roller 94. Thus, it is adapted to detect the surface temperature of the pressurizing roller 94. Additionally, thermistor 99*c* is arranged in a region of the heating roller 93 located outside the area wound by the fixing belt 91. Thus, it is adapted to detect the surface temperature of the fixing belt 91.

The use of the fixing belt 91 makes it possible to curtail the time necessary for starting up the machine and produce fine (sharp) images because the pressure necessary for the fixing operation is produced by the sponge and rubber of the belt so as to prevent toner from being crushed and spread.

Now, the operation of the fixing device 60 will be described. In the fixing device 60, the fixing roller 92 is driven to rotate by a motor (not shown) in the direction of arrow a. The fixing belt 91, the heating roller 93 and the pressurizing roller 94 follow the rotary motion of the fixing roller. The fixing belt 91 is heated in the area that is brought to contact the heating roller 93 and the heated area eventually gets to the nip section formed by the fixing roller 92 and the pressurizing roller 94 as the fixing belt 91 rotates. As the copying sheet P passes through the nip section, the unfixed toner that has been transferred onto the copying sheet P is brought to contact the fixing belts 91 and fixed to the copying sheet P by heat and pressure.

Figure 5:
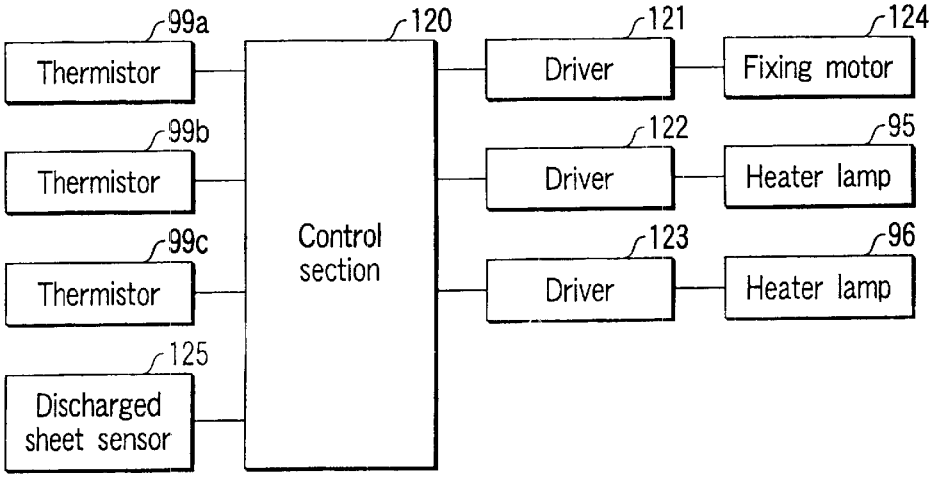
FIG. 5 is a schematic block diagram of the fixing device.

Now, the control circuit 120 arranged in the inside of the fixing device 60 will be described below by referring to FIG. 5.

The control circuit 120 is provided to control the fixing temperature of the fixing device 60. The control circuit 120 is connected to the thermistors 99*a*, 99*b*, 99*c*, driver 121, 122, 123 and discharged sheet sensor 125 and fed with control signals from the main control section 110. The driver 121 is adapted to drive fixing motor 124 for driving the fixing roller 92 to rotate. As the fixing roller 92 rotates, the fixing belt 91 and the heating roller 93 rotate. The drivers 122, 123 are used to turn on the heater lamps 95, 96 respectively.

The discharged sheet sensor 125 is adapted to detect the copying sheet P being discharged from the fixing device 60.

As a printing signal is input to the control circuit 120 from the main control section 110, the control circuit 120 drives main motor 124 according to the signal and then carries out a fixing operation by driving the heater lamps 95, 96 according to the temperature detection signals from the thermistors 99*a*, 99*b*.

In a cardboard mode, the control circuit 120 drives the fixing roller 92 to rotate according to the printing signal and subsequently controls the heater lamp 95 so as to bring the surface temperature of the heating roller 93 to temperature T1 selected for the operation of printing an image in the cardboard mode according to the temperature Th detected by the thermistor 99*a*.

Figure 6:
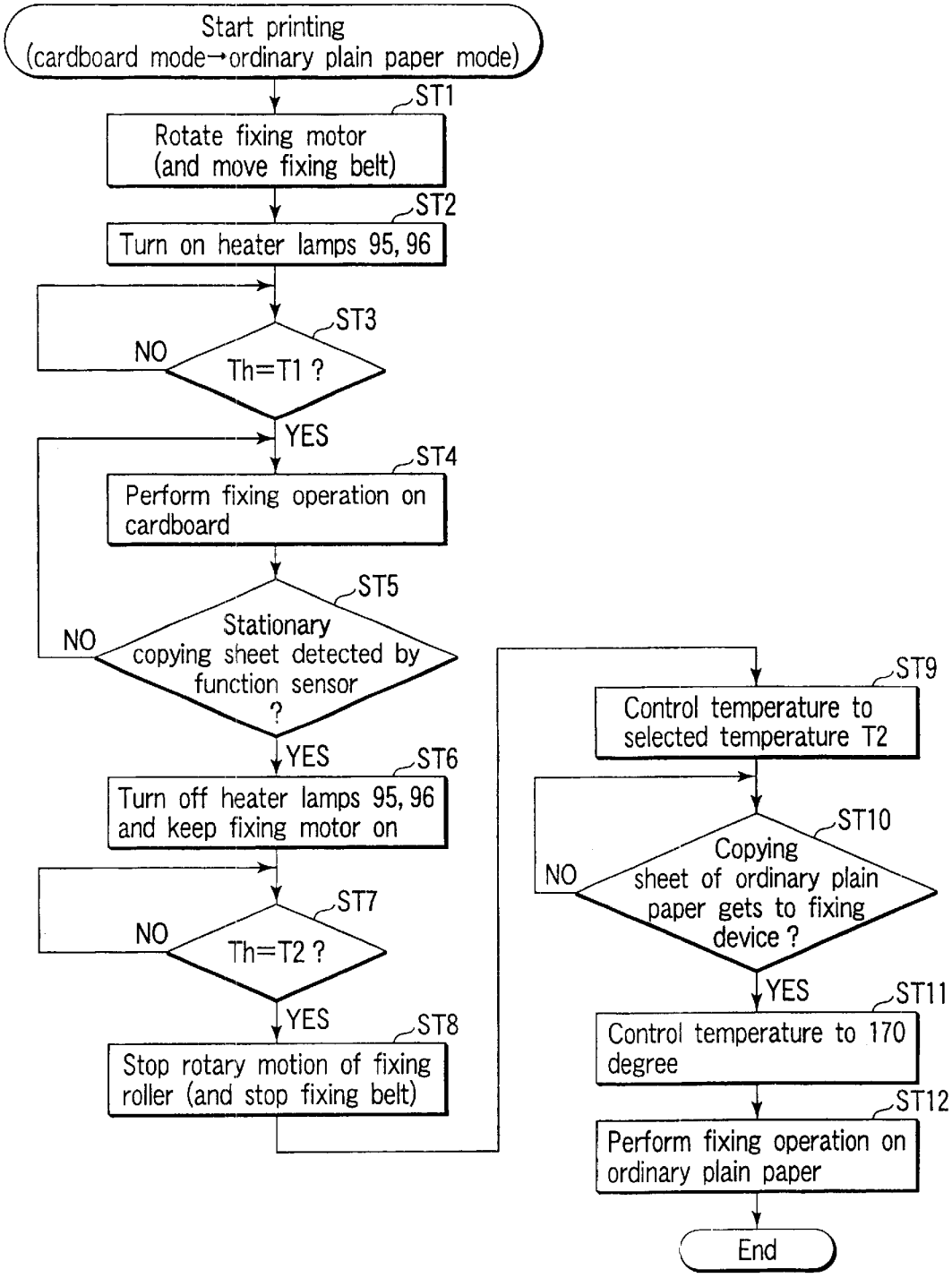
FIG. 6 is a flow chart illustrating a temperature control operation.
Figure 7:
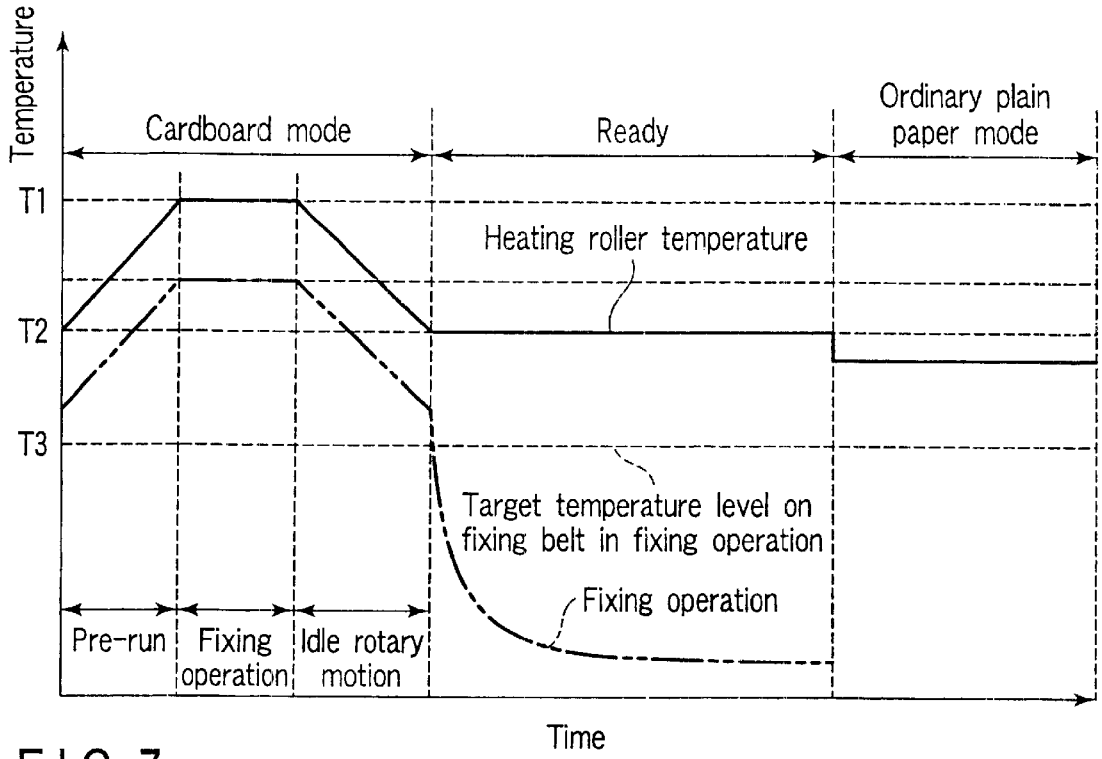
FIG. 7 is a graph illustrating the transition of the surface temperature of the heating roller and that of the surface temperature of the fixing belt when a temperature control operation is conducted.

Now, the fixing operation of the fixing device 60 having the above described configuration will be described by referring to the flow chart of FIG. 6 and the graph of FIG. 7 illustrating the transition of the surface temperature of the heating roller 93 and that of the surface temperature of the fixing belt 91 when a temperature control operation is conducted.

Assume here that the operator selected a sheet of cardboard 3 for the current copying operation and a sheet of ordinary plain paper for the next copying operation by means of the operation panel 111.

As the copying sheet P of cardboard is brought to a position located in front of the fixing device and separated from the latter by a predetermined distance, the control section 110 drives the driver 121 according to the control signal (printing signal in a cardboard mode) fed from the main control section 101 to by turn drive the fixing motor 124 (ST1). As the fixing motor 124 turns, the fixing roller 92 is driven to rotate and, as a result of the rotary motion of the fixing roller 92, the fixing belt 91 is driven to move and in turn drives the heating roller 93 and the pressurizing roller 94 to rotate. The main control section 101 also drives the drivers 122, 123 to turn on the heater lamps 95, 96 (ST2).

Thus, as the heater lamp 95 is turned on, the heating roller 93 is heated and heat is transmitted from the heating roller 93 to the fixing roller 92 by way of the fixing belt 91. The pressurizing roller 94 is also heated as the heater lamp 96 is turned on.

The above described predetermined distance is the traveling distance of the copying sheet P that corresponds to the time period from the time when the detection temperature Th of the thermistor 99*a* is equal to selected temperature T2 (180 degrees) to the time when the detection temperature is equal to selected temperature T1 (205 degrees).

As a result, the control section 120 takes a pre-run for the detection temperature Th of the thermistor 99*a* to get to the selected temperature T1 (205 degrees) from the selected temperature T2 (180 degrees) (ST3).

Thereafter, as the copying sheet P of cardboard is conveyed, the toner image is fixed at the nip section (ST4). At this time or operation, the control section 120 performs a temperature control operation by controlling the on/off operations of the heater lamps 95, 96 and the rotary motion of the fixing roller 92 so as to maintain the detection temperature Th of the thermistor 99*a* to the selected temperature T1 (205 degrees) and the detection temperature of the thermistor 99*b* to 155 degrees.

When the trailing edge of the (last) copying sheet P of cardboard is detected by the discharged sheet sensor 125 (ST5), the control section 120 does not stop the fixing motor 114 but drives the fixing roller 92 to idly rotate in a state where the heater lamps 95, 96 are turned off (ST6). As the fixing roller 92 rotates, the fixing belt 91 is driven to move so that the fixing belt 91 absorbs heat from the heating roller 93 and subsequently discharges heat while it is moving. As a result, the temperature (heat) of the heating roller 93 is reduced faster if compared with the case where it passively emits heat.

When the temperature of the heating roller 93, or the detection temperature Th of the thermistor 99*a*, gets to the selected temperature T2 (180 degree) (ST7), the control section 120 judges that the fixing device is now in a ready state and hence stops the idle rotation of the fixing roller 92 and also the motion of the fixing belt 91 (ST8).

Thereafter, the control section 120 carries on its temperature control operation by controlling the on/off operations of the heater lamp 95 and the rotary motion of the fixing roller 92 so as to maintain the detection temperature Th of the thermistor 99*a* to the selected temperature T2 (180 degree) (ST9).

Then, as the succeeding copying sheet P of ordinary plain paper reaches the fixing device 60 without interruption (ST10), the control section 120 performs its temperature control operation of maintaining the temperature of the heating roller 93, or the detection temperature Th of the thermistor 99*a*, to 170 degree and that of the pressurizing roller 94, or the detection temperature of the thermistor 99*b*, to 145 degree by controlling the on/off operations of the heater lamps 95, 96 and the rotary motion of the fixing roller 92 (ST11).

As a result, the toner image is fixed in the nip section as the copying sheet P of ordinary plain paper is conveyed there (ST12).

At this time, the selected temperature T1 is 205 degrees and the selected temperature T2 is 180 degrees, whereas the selected temperature T3 is 160 degrees and the temperature of the fixing belt 91 after the idle rotation, or the detection temperature of the thermistor 99*b*, is 100 degrees.

Now, a case where a copying sheet P of thin paper is selected as the succeeding copying sheet, onto which a toner image is fixed without interruption, will be described below.

As the copying sheet P of thin paper, onto which a toner image is fixed without interruption, reaches the fixing device 60, the control section performs a temperature control operation of maintaining the temperature of the heating roller 93, or the detection temperature Th of the thermistor 99*a*, to 145 degree and that of the pressurizing roller 94, or the detection temperature of the thermistor 99*b*, to 135 degree by controlling the on/off operations of the heater lamps 95, 96 and the rotary motion of the fixing roller 92.

As a result, the toner image is fixed in the nip section as the copying sheet P of thin paper is conveyed there.

While halogen lamps are used as heat sources in the above description of this embodiment, the present invention is by no means limited thereto and any of various heat sources such as those employing an induction heating system that comprises an induction heating coil may alternatively be used.

Figure 8:
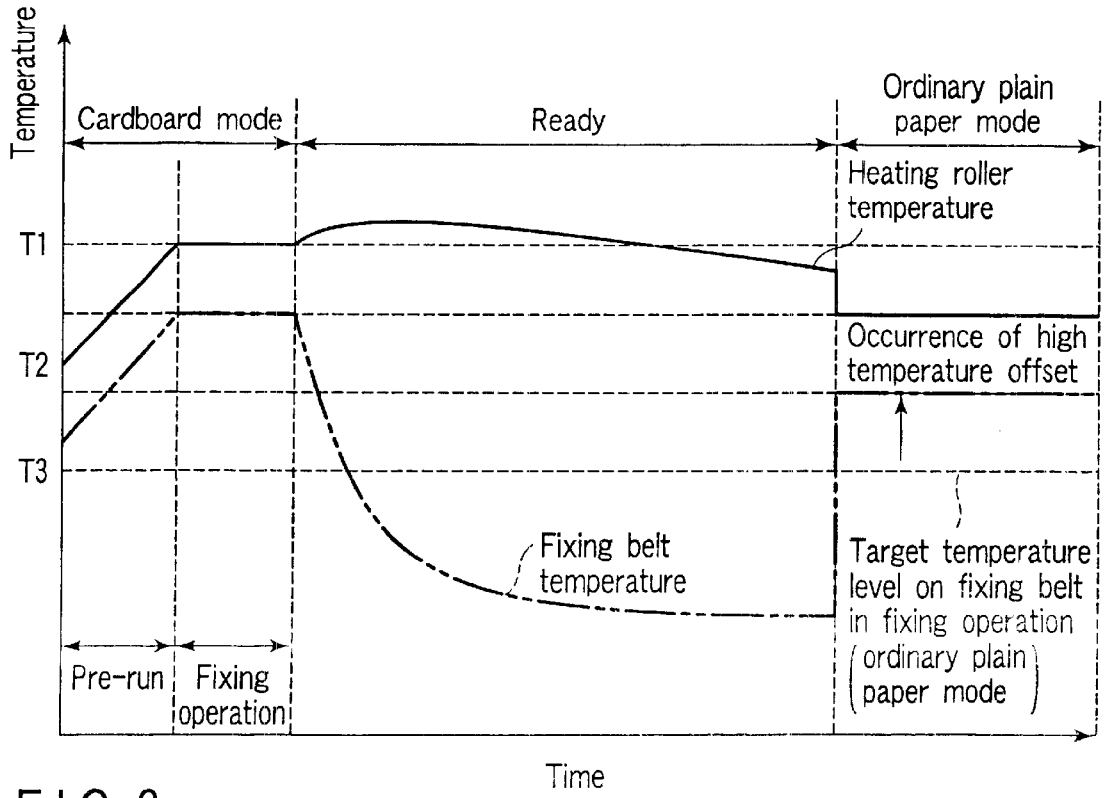
FIG. 8 is a graph illustrating the transition of the surface temperature of the heating roller and that of the surface temperature of the fixing belt when a conventional fixing operation is conducted.

With any of the known methods, the rotary motion of the fixing belt 91 is stopped when a printing operation in a cardboard mode is terminated so that, if the succeeding printing operation is conducted in an ordinary plain paper mode immediately thereafter, the temperature of the heating roller 93 is raised by the residual heat to in turn raise the temperature of the fixing belt 91 above the ordinary level as shown in FIG. 8 and give rise to a problem of high temperature offset. Additionally, even if a copying sheet P is fed after the temperature of the heating roller 93 has fallen to the selected temperature T3 for an ordinary plain paper mode, the fast copying operation takes a considerably long time because it takes time for the fixing belt to spontaneously cool down.

To the contrary, with this embodiment, the fixing belt 91 is made to rotate idly when the heating roller 93 is turned off after the end of a printing operation and the heating roller 93 is cooled to the selected temperature T2, where the fixing device is in a ready state. Thus, the embodiment is free from the problem of high temperature offset that accompanies the known methods and can curtail the time required for fast copying.

As pointed out above, known fixing devices of the type under consideration are adapted to stop the operation of the fixing device and also that of the conveyance system after a printing operation so that the temperature of the heating roller and that of the fixing belt are raised by the residual heat. Therefore, when a printing operation is conducted in an ordinary plain paper mode after a printing operation in a cardboard mode, the temperature of the fixing belt rises above the target level to give rise to a problem of high temperature offset.

In an attempt for avoiding this problem, an image forming apparatus is so controlled that no sheets of recording paper pass through it until the temperature of the fixing belt reaches the target level. Then, however, there arises a problem that a printing operation in a fast copy mode is a time consuming one because the cooling rate is low when the fixing belt is left to cool down spontaneously.

According to the present invention, the fixing belt is made to rotate idly after a copying operation in a cardboard mode is terminated in order to cool the heating roller to the level of the selected temperature where the fixing device is in a ready state. With this arrangement, if the next printing operation is conducted in an ordinary plain paper mode, the temperature of the belt in the fixing nip section is held to a controlled level so as to prevent any problem of high temperature offset from taking place and reduce the time required for fast copying.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising a fixing device for fixing a color developer image on an image forming medium having a thickness selected from a number of different thicknesses, said fixing device including:

a fixing roller for fixing a color developer image of an image forming medium having a thickness selected from a number of different thicknesses at a temperature selected from a number of different temperatures corresponding to said thicknesses of image forming medium;

a heating roller containing a heater and adapted to be heated by said heater;

a fixing belt wound around said fixing roller and said heating roller and adapted to move around said rollers so as to transmit heat from said heating roller to said fixing roller;

a first drive section for driving said heater;

a second drive section for rotating said fixing roller and moving said fixing roller;

a detector for detecting the temperature of said heating roller; and a control section for controlling said heater, said first drive section, said second drive section, and said detector, wherein when a first fixing operation is performed with respect to an image forming medium having a first thickness, said control section controls said first drive section to turn said heater on or off and further controls said second drive section to rotate said fixing roller and move said fixing belt such that the temperature detected by said detector is kept at a first setting temperature, when a second fixing operation is performed with respect to an image forming medium having a second thickness less than the first thickness, said control section controls said first drive section to turn said heater on or off and further controls said second drive section to rotate said fixing roller such that the temperature detected by said detector is kept at a second setting temperature lower than the first setting temperature, and when the first fixing operation is followed by the second fixing operation, said control section turns off said heater after said image forming medium having the first thickness passes said fixing roller and allows said second drive section to continue to operate until the temperature detected by said detector lowers to the second setting temperature.

2. The apparatus according to claim 1, wherein said heater is a halogen lamp.

3. The apparatus according to claim 1, wherein a pressurizing roller is arranged in said fixing device at a position opposite said fixing roller with a nip section of the fixing belt pinched between them and said pressurizing roller contains said heater in the inside.

4. The apparatus according to claim 1, further comprising:

a third control section adapted to provide a plurality of predetermined different temperature levels selected for one of a number of different types of image forming medium having different thicknesses and maintain the predetermined temperature levels corresponding to the selected one of the different types of image forming medium.

5. A fixing method for use in an image forming apparatus comprising a fixing device for fixing a color developer image on an image forming medium having a thickness selected from a number of different thicknesses, wherein said fixing device includes:

a fixing roller for fixing a color developer image of an image forming medium having a thickness selected from a number of different thicknesses at a temperature selected from a number of different temperatures corresponding to said thicknesses of image forming medium;

a heating roller containing a heater and adapted to be heated by said heater;

a fixing belt wound around said fixing roller and said heating roller and adapted to move around said rollers so as to transmit heat from said heating roller to said fixing roller;

a first drive section for driving said heater;

a second drive section for rotating said fixing roller and moving said fixing roller;

a detector for detecting the temperature of said heating roller; and a control section for controlling said heater, said first drive section, said second drive section, and said detector, and wherein said fixing method comprises:

a first step executed where a fixing operation performed with respect to an image forming medium having a first thickness is followed by a fixing operation performed with respect to an image forming medium having a second thickness less than the first thickness, said first step controls said first drive section to turn said heater on or off, and further controls said second drive section to rotate said fixing roller and move said fixing belt, such that the temperature detected by said detector is kept at a first setting temperature;

a second step executed after said image forming medium having the first thickness passes said fixing roller, said second step turning said heater off and allowing said second drive section to continue to operate until the temperature detected by said detector lowers to the second setting temperature; and a third step executed after the second step and where a fixing operation is performed with respect to the image forming medium having the second thickness, said third step controls the first drive section to turn the heater on or off, and further controls the second drive section to rotate the fixing roller, such that the temperature detected by the detector is kept at a second setting temperature lower than the first setting temperature.

6. A method of forming an image on an image forming medium, comprising:

determining a thickness of the image forming medium; heating a heating roller to a temperature corresponding to the thickness of said image forming medium;

moving a fixing belt about said heating roller and a fixing roller so as to transmit heat from said heating roller to said fixing roller; and fixing the image on said image forming medium with the fixing roller, wherein if the thickness of said image forming medium is a first thickness, said fixing roller is rotated, said fixing belt is moved, and said heating roller is heated so as to maintain the temperature of said heating roller at a first setting temperature, wherein if the thickness of said image forming medium is a second thickness less than the first thickness, said fixing roller is rotated, said fixing belt is moved and said heating roller is heated so as to maintain the temperature of said heating roller at a second setting temperature, and wherein if an image forming medium of the first thickness is to be followed by an image forming medium of the second thickness, said fixing belt is moved and said heating roller is turned off after said image forming medium of the first thickness passes said fixing roller.

* * * * *